US008556756B2

(12) United States Patent
McClung et al.

(10) Patent No.: US 8,556,756 B2
(45) **Date of Patent: *Oct. 15, 2013**

(54) GAME APPARATUSES

(76) Inventors: Karen Therese McClung, Rockport, TX (US); Guy L. McClung, III, Rockport, TX (US)

( * ) Notice: Subject to any disclaimer, the term of this patent is extended or adjusted under 35 U.S.C. 154(b) by 281 days.

This patent is subject to a terminal disclaimer.

(21) Appl. No.: 13/065,661

(22) Filed: Mar. 25, 2011

(65) Prior Publication Data

US 2012/0244957 A1 Sep. 27, 2012

(51) Int. Cl.
*A63B 49/04* (2006.01)

(52) U.S. Cl.
USPC ..... 473/519

(58) Field of Classification Search
USPC ..... 473/519–521, 524, 292, 297, 333
See application file for complete search history.

(56) References Cited

U.S. PATENT DOCUMENTS

| | | | | |
|---|---|---|---|---|
| 514,420 | A | 2/1894 | Jacobus | 473/564 |
| 2,028,291 | A | 1/1936 | MacPherson | 473/519 |
| 2,215,899 | A | 9/1940 | Beasley | 473/519 |
| 3,116,926 | A | 1/1964 | Owen et al. | 473/457 |
| 3,907,292 | A | 9/1975 | Moreland | 473/537 |
| 3,931,968 | A | 1/1976 | Hedberg | 473/552 |
| 4,027,881 | A | 6/1977 | Hufenus | 473/519 |
| 4,057,250 | A | 11/1977 | Kuban | 473/521 |
| 4,182,512 | A | 1/1980 | Kuebler | 473/521 |
| 4,273,331 | A | 6/1981 | Fischer | 473/543 |
| 4,275,885 | A | 6/1981 | Howe | 473/536 |
| 4,325,549 | A | 4/1982 | Vasselli | 473/519 |
| 4,330,125 | A | 5/1982 | Sassler | 473/521 |
| 4,340,225 | A | 7/1982 | Wilson | 473/534 |
| 4,512,574 | A | 4/1985 | Klaila | 475/550 |
| 4,541,631 | A | 9/1985 | Sasse | 473/297 |
| 4,685,675 | A | 8/1987 | Heiman | 473/519 |
| 4,715,606 | A | 12/1987 | Varley | 473/256 |
| 4,984,792 | A | 1/1991 | Pacanski | 473/519 |
| 5,082,279 | A | 1/1992 | Hull et al. | 473/242 |
| 5,098,098 | A | 3/1992 | Petralia | 473/521 |
| 5,171,011 | A | 12/1992 | Squadroni | 473/519 |
| 5,172,911 | A | 12/1992 | Chang | 473/521 |
| 5,174,568 | A | 12/1992 | You | 473/521 |
| 5,188,360 | A | 2/1993 | Chen | 473/519 |
| 5,197,732 | A | 3/1993 | Lanctot | 473/523 |
| 5,211,398 | A | 5/1993 | Awano et al. | 473/535 |
| 5,217,223 | A | 6/1993 | Feeney | 473/535 |
| 5,219,166 | A | 6/1993 | Chang | 473/521 |
| 5,232,220 | A | 8/1993 | Poschenrieder | 473/535 |
| 5,240,247 | A | 8/1993 | Didier | 473/523 |
| 5,322,280 | A | 6/1994 | Wu | 473/523 |
| 5,454,562 | A | 10/1995 | Sommer | 473/523 |
| 5,460,378 | A | 10/1995 | Getts | 473/251 |
| 5,772,540 | A | 6/1998 | Kuebler | 473/519 |
| 5,776,006 | A | 7/1998 | Gruber | 473/256 |
| 5,779,571 | A | 7/1998 | Roggenkamp | 473/519 |
| 5,803,829 | A | 9/1998 | Hayashi | 473/326 |
| 6,254,502 | B1 | 7/2001 | Becker | 473/594 |
| 6,358,157 | B1 | 3/2002 | Sorenson | 473/219 |

(Continued)

*Primary Examiner* — Raleigh W Chiu
(74) *Attorney, Agent, or Firm* — Guy McClung

(57) ABSTRACT

Game apparatus, e.g., a game racquet or a golf club, with selectively variable and maintainable weight distribution, e.g. by moving material (e.g., liquid and/or solid weight members) within or on the apparatus and selectively positioning the weight(s) and maintaining weight position in or on the apparatus; in one aspect, the game apparatus having dual opposed channels for weight members; and in one aspect a set of a plurality of weight members for connection to a game apparatus.

15 Claims, 15 Drawing Sheets

(56) References Cited

U.S. PATENT DOCUMENTS

| | | | | |
|---|---|---|---|---|
| 6,461,259 | B1 | 10/2002 | Li | 473/519 |
| 6,623,383 | B2 | 9/2003 | Matsuoka et al. | 473/519 |
| 7,918,752 | B2 * | 4/2011 | McClung et al. | 473/519 |
| 2003/0109337 | A1 | 6/2003 | Yang et al. | 473/519 |
| 2010/0022326 | A1 | 1/2010 | McClung et al. | 473/333 |

* cited by examiner 30
31
32
33
34
35
38
30
32
33
34
35
38
38a
38b
34a
30a
35a
32a
39d
38d
38e
38f
34d
35d
30d
32d

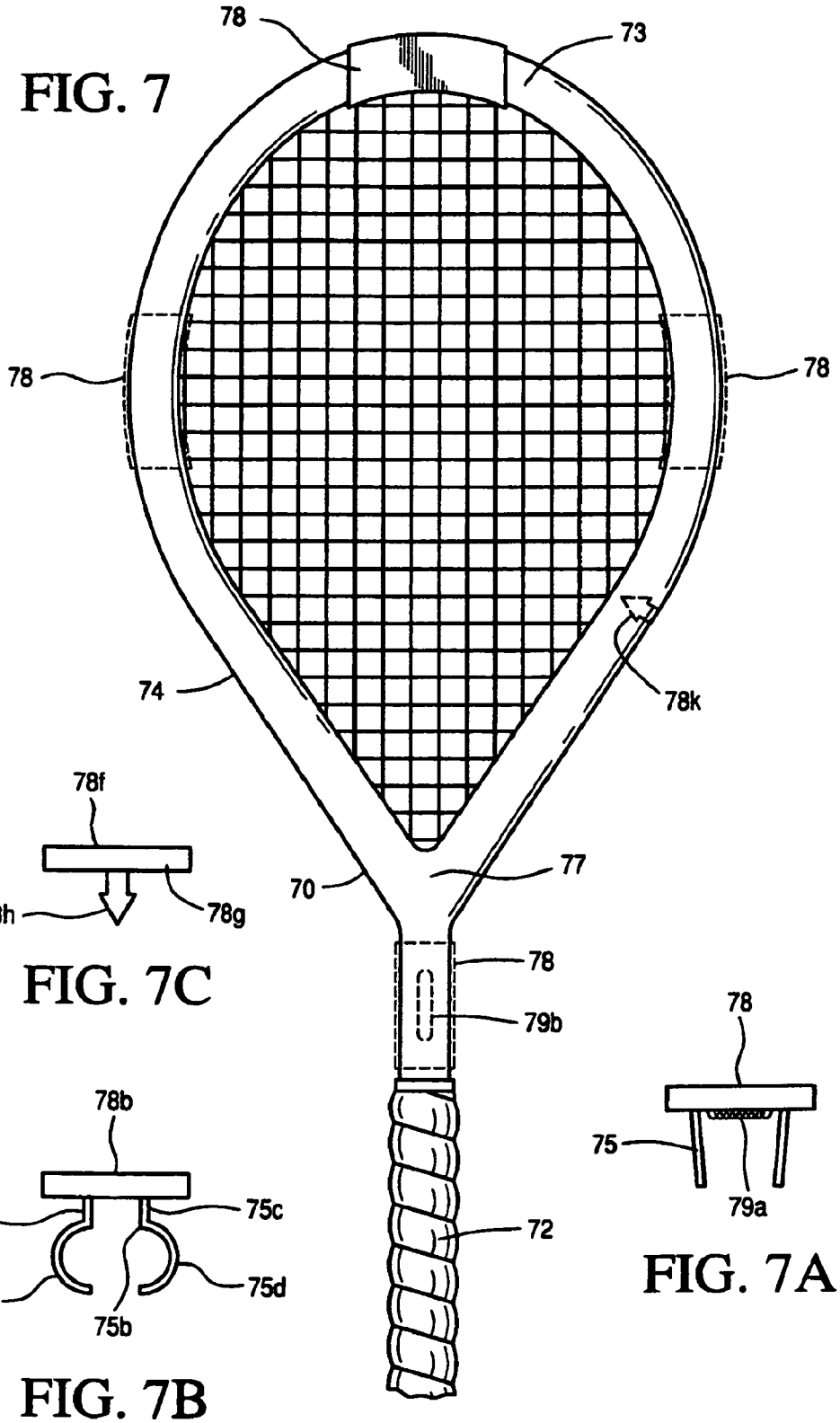
FIG. 7
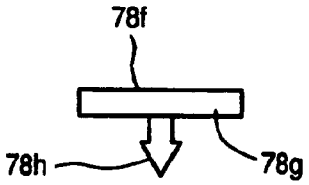
FIG. 7C
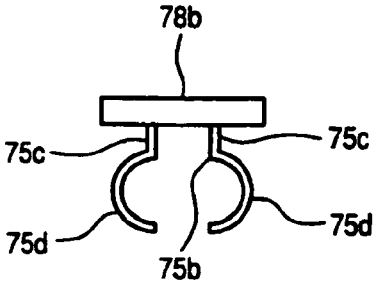
FIG. 7B
FIG. 7A 163
167
164

160
162
166
164
163
165
161
170

174
173
176
172

173
171
180
182

183
184
185

183
188
189
181

GAME APPARATUSES

CROSS-REFERENCE TO RELATED APPLICATIONS

The present invention and application claim priority under the United States Patent Laws from U.S. Application Ser. No. 60/860,408 filed Nov. 21, 2006 and U.S. application Ser. No. 12/312,617 filed May 19, 2009 issued as U.S. Pat. No. 7,918,752 on Apr. 5, 2011, all said applications and said patent incorporated fully herein for all purposes. This is a continuation-in-part of U.S. application Ser. No. 12/312,617.

BACKGROUND OF THE INVENTION

1. Field of the Invention

This invention is directed to game racquets, to game racquets with selectively positionable weight(s), and to racquets with maintenance apparatus for maintaining a weight or weights in a desired position in or on a racquet.

2. Description of Related Art

The prior art discloses a wide variety of game racquets and golf clubs.

The following U.S. Patents—listed simply as examples and not as an exhaustive list—disclose a variety of prior art racquets: U.S. Pat. Nos. 5,772,540; 5,454,562; 5,322,280; 5,240,247; 5,232,220; 5,219,166; 5,217,223; 5,211,398; 5,197,732; 5,188,260; 5,174,568; 5,172,911; 5,171,011; 5,098,098; 4,984,792; 5,512,574; 4,330,125; 4,340,225; 4,275,885; 4,273,331; 4,182,512; 4,057,250; 4,027,881; 3,931,968; and 3,907,292, all of which are incorporated fully herein for all purposes.

BRIEF SUMMARY OF THE INVENTION

The present invention discloses, in certain aspects, a game racquet including: a body, part of the body defining a body opening therethrough, the body opening defined by a first side of the body and a second side of the body, the first side opposite the second side, the body having a top, the body opening having a bottom; a plurality of strings over the body opening; dual opposed channels within the body and adjacent the body opening which include a first body channel and a second body channel, the first body channel in the first side and the second body channel in the second side; the first body channel extending within the body from the top of the body to the bottom of the body opening; the second body channel extending within the body from the top of the body to the bottom of the body opening; a weight member is not passable from the first body channel to the body second channel; a first weight member (which may be a single or multiple things) movably disposed within the first body channel; a second weight member (which may be a single or multiple things) movably disposed within the second body channel; movement of each weight member within its respective channel initiated by manipulation of the body to subject the weight material to force that moves the weight material. In certain aspects the manipulation is the swing of a racquet to hit a ball; serving a ball with a racquet; tilting a racquet or a golf club; inverting a racquet or a golf club; or hitting or putting a golf ball with a golf club. In certain aspects, due to the dual opposed channels, weight members move in balanced even fashion on both sides of the racquet; for example, but not limited to, when serving a tennis ball.

In certain aspects, such a racquet has a handle connected to the body, the handle having a first handle channel in communication with the first body channel, the first weight member movable within the first handle channel and movable from and to the first body channel; and the handle having a second handle channel in communication with the second body channel, the second weight member movable within the second handle channel and movable from and to the second body channel. Such a racquet may also have a lower end and the first handle channel extending to a point within the handle adjacent the lower end of the handle, and the second handle channel extending to a point within the handle adjacent the lower end of the handle.

In certain aspects, the present invention discloses a set of weight members for a game apparatus, the set including: a plurality of weight members, each weight member connectable to the game apparatus, each weight member different from the other weight members. The weight members can differ in one or some of the following: weight; density; size; shape; color; volume; and/or marking indicia. The game apparatus may be, but it not limited to, a golf club or a racquet.

In certain aspects, the weight members of a set are fixed to a game apparatus with an adhesive or a connector. In other aspects each weight member is releasably connectible to a game apparatus. In certain aspects, the releasable connection is by one of friction fit and snap fit.

FIG. 2B is a side view of the racquet of FIG. 2A.

In certain aspects, a weight member or weight members of a set of weight members according to the present invention has a surface and when the weight member is connected to a game apparatus it does not project beyond the surface of the game apparatus.

The present invention, in one aspect, discloses a game racquet with a handle portion and a body portion across which are stretched a plurality of strings, the strings connected to the body. The body portion or part thereof is hollow and/or the handle or part thereof is hollow. Material (liquid and/or liquid with a solid or solids) and/or one or more movable weight members are movably disposed within a hollow part and are movable, either by hand or when the racquet is swung, tilted or inverted, from one location to another, e.g. to the top of the racquet to change the weight distribution of the racquet during a hit or serve. Alternatively, a channel member or a weight member (or plurality thereof) are releasably located on the body of a racquet. A golf club according to the present invention has a hollow channel extending from a club shaft into a space in a club head, a weight member or members and/or liquid in or on the shaft movable to the head.

The present invention discloses, in at least certain embodiments, a game racquet with: a body, part of the body defining a body opening therethrough; a plurality of strings across the body opening and connected to the body; an interior channel extending through at least a portion of the body, the interior channel having at least a first part and a second part; weight material (liquid and/or solid member or members) movably disposed in the interior channel for movement between the first part and the second part; and maintenance apparatus adjacent (in and/or on or near) the interior channel for selectively maintaining the weight material in one of the first part and the second part.

Weight relocation, in certain embodiments, moves (and/or enlarges) a racquet's sweetspot to another location in the racquet, in one aspect to relocate the sweetspot, and in one aspect toward or to the top of the racquet enhancing a player's ability to hit the ball at the sweetspot and/or enhancing the force with which a player hits a ball. After a hit of a ball or a serve, tilting or re-inversion of the racquet results in movement of the liquid or weight(s) moving back to an original position; or in certain embodiments the movable material moves down in a handle, thus decreasing the amount of energy needed to move and swing the racquet in play in certain ways after the serve or after a hit of the ball.

In certain aspects, in a racquet or club according to the present invention, movable weights are used which are spherical such as solid spheres, ball bearings or marbles made from a material of desired density to achieve a desired weight (e.g. metal, stone, composite, plastic). In another aspect a lubricant may be used with weight member(s). In another aspect movable weight(s) are configured to conform with an exterior shape or interior shape of a portion or of a hollow portion of a racquet or a club.

In another embodiment an amount of a liquid (e.g. but not limited to water, alcohol, oil and antifreeze—or any combination thereof) or a liquid with objects, solids, weights, or particles therein, is movably disposed in part of a hollow body; or in an embodiment in which the handle is hollow, initially in the hollow handle. Upon tilting, swinging in an arc, or inversion of the racquet or club, the liquid flows in the hollow part (and/or weight member or members), in one aspect toward the top of the hollow body member of a racquet or to a head of a club, and due to centrifugal force stays there during arcing movement of a hit, drive, or serve.

In certain embodiments in which a liquid or a solid movable weight or weights are used, a selectively actuable maintenance apparatus maintains the weight(s) in a desired location (e.g. in a top area of a racquet or in the handle of a racquet) and prevents the repositioning of weight(s) (liquid and/or solid) which have moved from one part to another. With practice, a player can allow less than all of the movable weight to move from one part to another in the body.

In another embodiment in which an amount of material (liquid and/or a weight member or members) is in the hollow body and/or hollow handle, the maintenance apparatus is a valve device which allows a player to selectively permit some or all of the material to move from one location to another in or on the racquet.

In certain embodiments movable weight members and/or liquid are introducible onto or into a racquet's hollow body and/or handle or into a club shaft through one or more holes or openings; and may be selectively removed therethrough, e.g. after a hit, drive, or serve.

In certain aspects a racquet or club according to the present invention has a channel member with a hollow channel therein affixed (permanently or releasably) to a body (e.g. a racquet frame, club shaft, or club head) and weight material (liquid and/or solid member or members) as described herein is movable in the channel member. In one aspect the channel member is tubing (flexible or rigid) with the material therein. In one aspect the tubing is releasably connectable to the body, e.g. with friction fit connectors or clasps, with adhesive, with hook-and-loop releasably cooperating fastener material like VELCRO (Trademark) material, and/or with one or more wrap-around strings, wires, belts, loops and/or straps. The tubing can be sealed permanently or it can have one or more openable or pluggable closures for inserting and/or removing material (liquid and/or a weight member or members). A flexible tubing can be formed to fit a plurality of racquets or clubs with different body shapes or curvatures. Any maintenance apparatus disclosed herein can, according to the present invention, be used with any channel member or tubing disclosed herein.

In certain embodiments the present invention discloses a golf club with a body with any channel or channel member as described herein for containing material to flow to a head of the golf club upon swinging of the club; and/or with a weight movable in or on club shaft. the present invention discloses, in certain embodiments, a golf club with: a head, the head having an interior space therein; a shaft connected to the head; weight material movably disposed with respect to the shaft for movement between a first position with respect to the shaft and a second position with respect to the shaft. In one aspect, the head has an interior hole, the shaft is hollow, the weight material is within the shaft, and part of the shaft extends into the hole in the head so that the weight material is movable into the interior space in the head. The weight material is liquid or is at least one weight member or a plurality of weight members movably within or secured around the shaft.

BRIEF DESCRIPTION OF THE SEVERAL VIEWS OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 7 is a front view of a racquet according to the present invention.

FIG. 7A is an end view of weight member according to the present invention.

FIG. 7B is an end view of weight member according to the present invention.

FIG. 7C is an end view of weight member according to the present invention.

DETAILED DESCRIPTION OF THE INVENTION

Figure 1B:
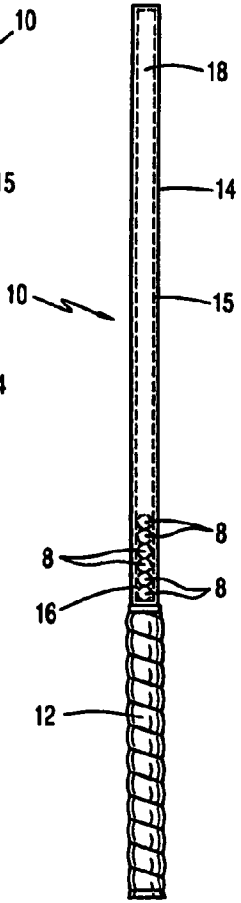
FIG. 1B is a side view of the racquet of FIG. 1A.
Figure 1A:
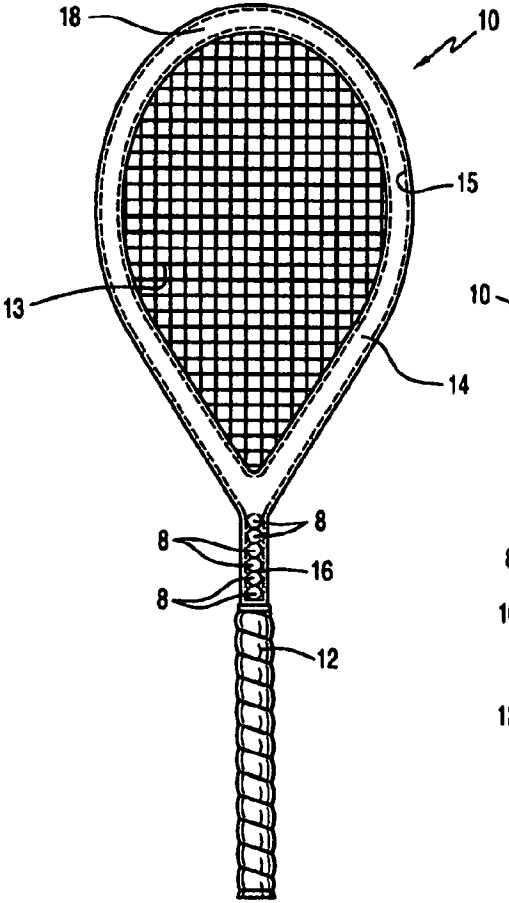
FIG. 1A is a front view of a racquet according to the present invention.

Referring now to FIGS. 1A and 1B, a game racquet has a handle 12 and a body 14 to which are connected and across which are stretched a plurality of strings 13. The handle 12 is hollow, but in certain embodiments may be solid or partially solid. A plurality of movable weight members 8 are movably disposed in an interior channel 15 (shown in dotted lines) in the body 14 and handle 12. Upon swinging or inversion of the racquet 10, the weight members 8 move from an interior 16 of the handle 12 to a top 18 of the body 14. Upon arcing movement of the racquet 10, e.g. during a serve or other movement of the racquet, centrifugal force maintains the weight members at the top 18 of the body 14. Upon tilting or re-inversion of the racquet, the weight members 8 move back down into the interior 16 of the handle 12. (it is to be understood that any racquet according to the present invention and any racquet described below has strings, e.g. strings like the strings 13.)

Figure 2B:
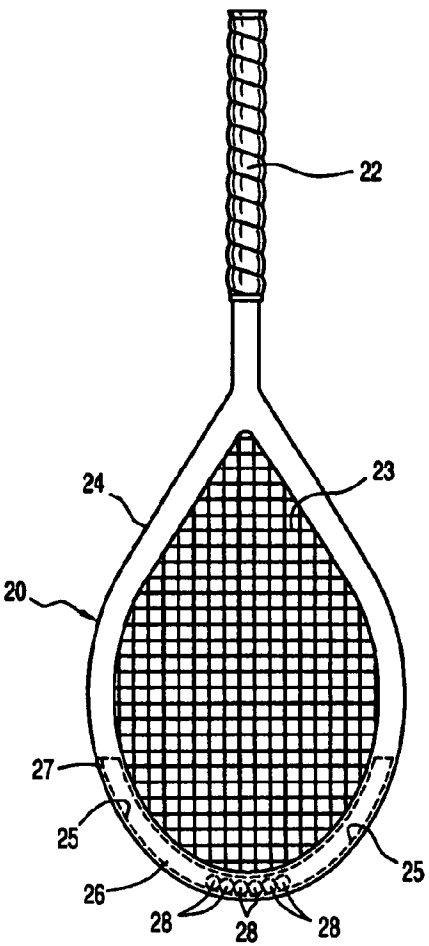
FIG. 2B is a side view of the racquet of FIG. 2A.
Figure 2A:
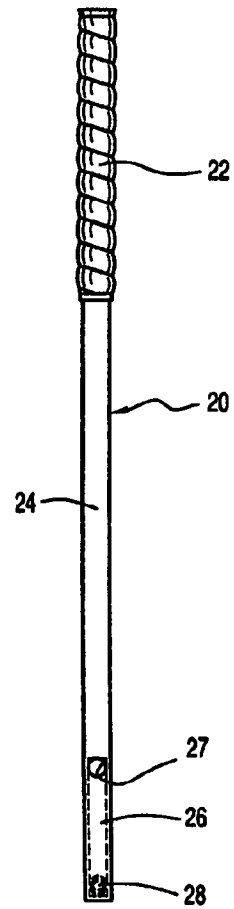
FIG. 2A is a front view of a racquet according to the present invention.

Referring now to FIGS. 2A and 2B, a game racquet 20 has a handle 22 and a body 24 to which are connected and across which are stretched a plurality of strings 23. One or more movable metal ball bearings 28 are movably disposed in an interior channel 25 in the body 24. Upon inversion of the racquet 20, the ball bearings 28 move to a top 26 of the body 24. Upon arcing movement of the racquet 20, e.g. during a serve or other swing or movement of the racquet, centrifugal force maintains the ball bearings 28 at the top 26 of the body 24. Weight member(s) such as the ball bearings 28 are introducible into the interior channel 25 and removable therefrom through a hole 27 in the body 24. The channel 25 may be any desired length and the hole 27 may be located as desired, in one aspect so that the weight members may be located as desired, and in one aspect so that the weight members will not fall out upon inversion of the racquet. Upon tilting of the racquet, the weight members move back to the hole 27 for removal from the body 24. Only one weight member 28 may be used. Alternatively liquid or liquid with solids is introduced through the hole 27 (and tape or a plug is used to close off the hole 27).

Figures 3A, 3B, 3C, 3D:
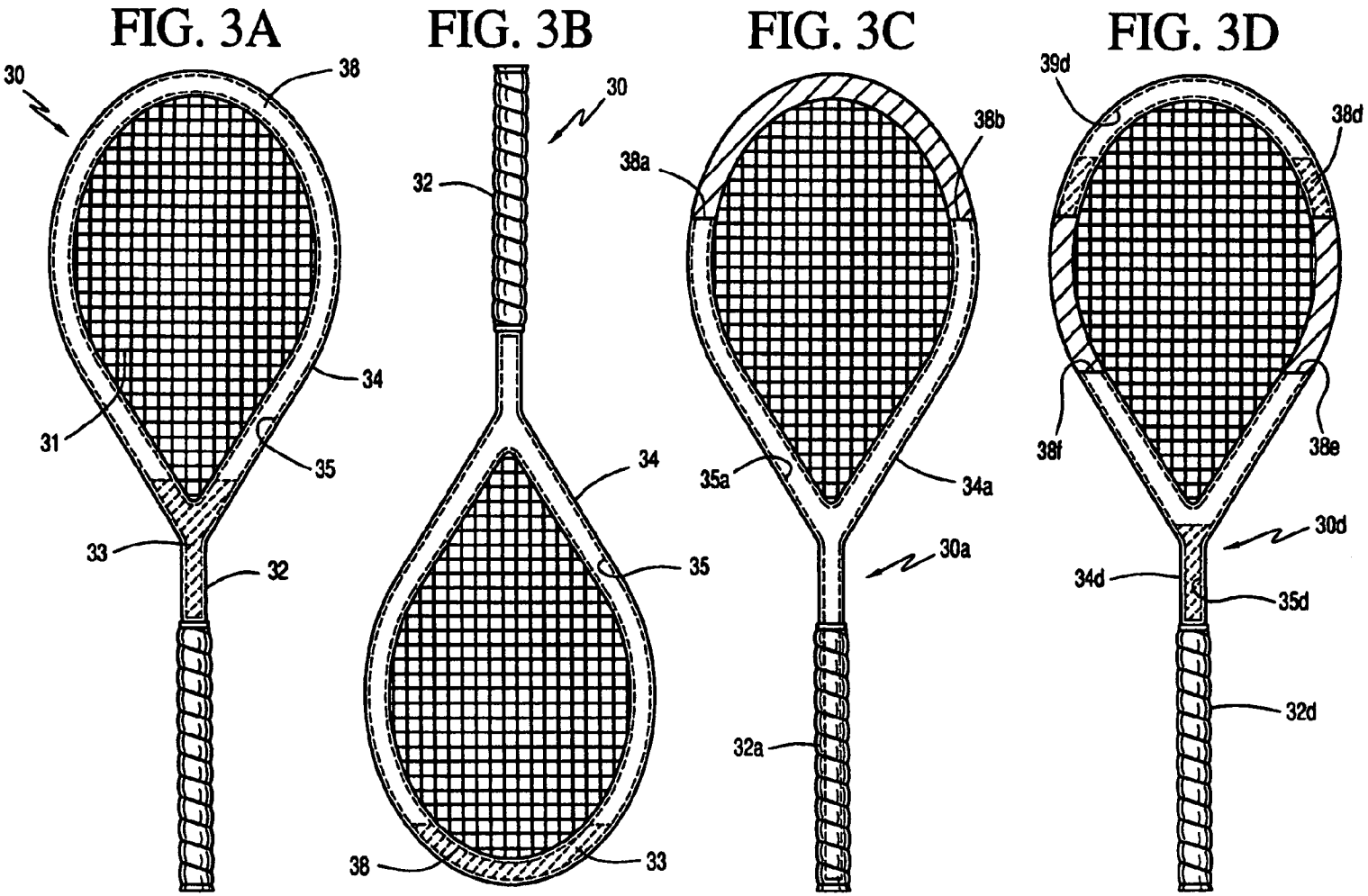
FIG. 3A is a front view of a racquet according to the present invention.
FIG. 3B shows the racquet of FIG. 3A inverted.
FIG. 3C is a front view of a racquet according to the present invention.
FIG. 3D is a front view of a racquet according to the present invention.

Referring now to FIGS. 3A and 3B, a racquet 30 according to the present invention has a handle 32 and a body 34 with an interior channel 35 therethrough and strings 31 (shown in FIG. 3A). An amount of liquid 33 is movably disposed in the interior channel 35. Upon inversion of the racquet 30, the liquid 33 moves from the handle 32 to a top 38 of the body 34. Upon arcing movement of the racquet 30, e.g. during a serve or other movement of the racquet, centrifugal force maintains the liquid at the top 38 of the body 34. Upon re-inversion of the racquet the liquid moves back down into handle 32. As may be done with any racquet according to the present invention, the liquid 33 may be replaced with any weight member(s) disclosed herein and/or liquid may be used in combination with weight member(s).

As shown in FIG. 3C, a racquet 30*a* (like the racquet 30) has a handle 32*a* and a body 34*a* with a solid portion at the top and with an interior channel 35*a* which extends from the handle 32*a* up into a portion of both sides of the body 34*a*. Upon inversion of the racquet 30*a*, liquid and/or weight members in the interior channel 35*a* moves from the handle 32*a* to abut portions 38*a*, 38*b* of the solid portion at the top of the body 34*a*.

As may be the case with any racquet according to the present invention, the solid portion at the top of the body 34*a* may be of any desirable extent, e.g. with the portions 38*a*, 38*b* located as desired; similarly the extent of the interior channel within the handle 32*a* may be any desired length—thus affecting how much liquid and/or weight member(s) is/are contained in the racquet and the location of the liquid and/or weight members upon inversion of the racquet.

It is within the scope of the present invention to provide a plurality of separate, discrete, distinct interior channels within the handle and/or body of a racquet or in the shaft and/or head of a golf club with liquid and/or weight members in each channel. The channels may be of any desired extent (and, as is true of any racquet or club according to the present invention, any channel may be of any desired diameter or largest dimension). As shown in FIG. 3D a racquet 30*d* according too the present invention (like the racquet 30) has a body 34*d* with a handle 32*d*. Upon inversion of the racquet

30*d*, the liquid and/or weight member(s) in interior channels 35*d* (in the handle and body) and interior channel 39*d* (at the top of the body) moves to the top of the respective channel. Liquid and/or weight member(s) in the handle portion of the interior channel 35*d* will move to abut solid portions 38*e*, 38*f* of a solid part 38*d* of the body. Optionally, either channel 35*d* or 39*d* may be deleted.

Figure 4A:
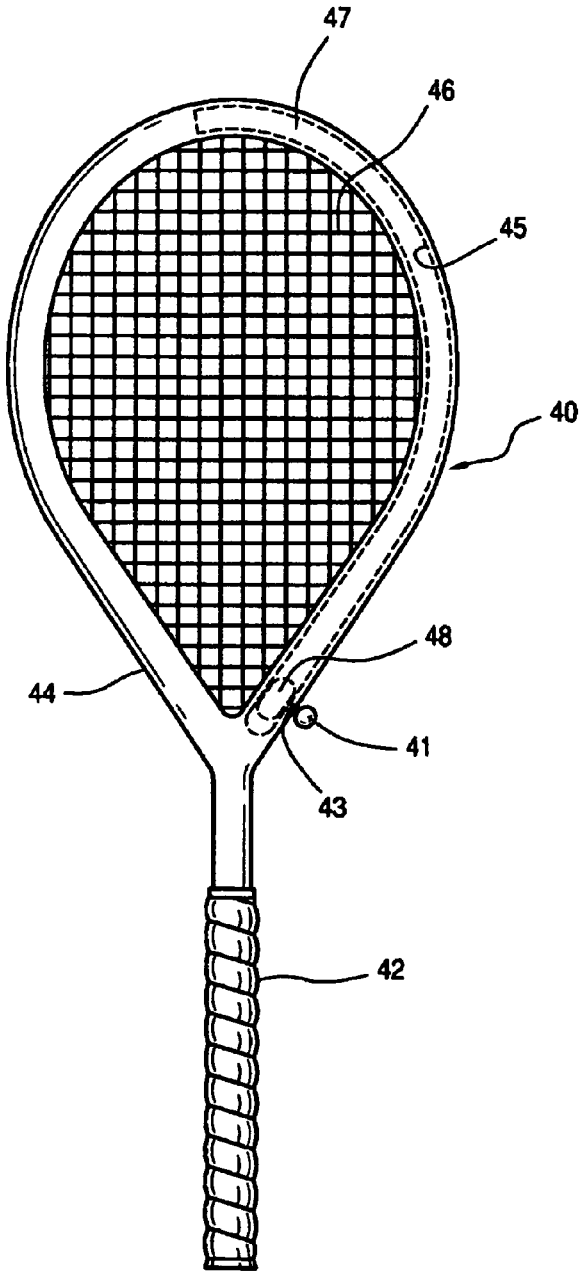
FIG. 4A is a front view of a racquet according to the present invention.
Figure 4B:
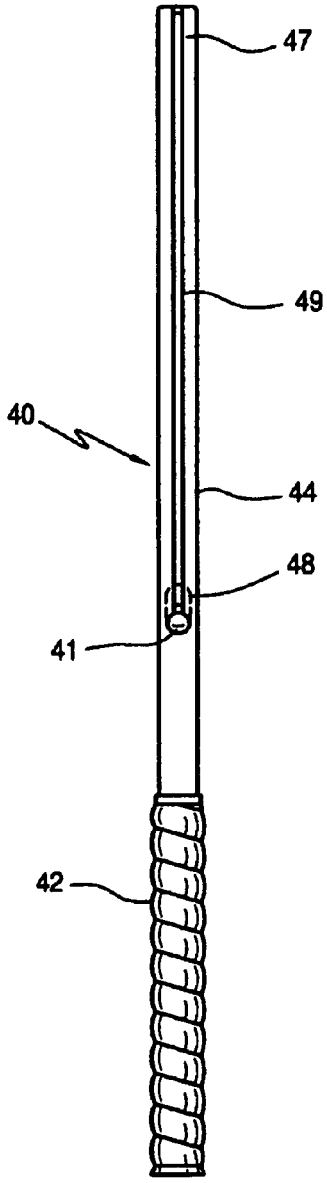
FIG. 4B is a side view of the racquet of FIG. 4A.

Referring now to FIGS. 4A and 4B, a game racquet 40 has a handle 42 and a body 44 across which are stretched a plurality of strings 46. A movable weight member 48 is movably disposed in an interior channel 45 in the body 44. A stem 43 connects the weight member 48 to a projection or knob 41 located exteriorly of the body 44 with the stem 43 movable in a slit 49 along the body 44 from a lower point to a top 47 of the racquet 40 to move the weight member within the channel 45. In another aspect the channel 45 may extend down any distance into the handle 42, e.g. but not limited to, to its lower extremity if desired. With a friction fit, the stem 43 can be held in position in the slit 49. At least one, one, two, three, four, five, or more weight members may be used.

Figure 4C:
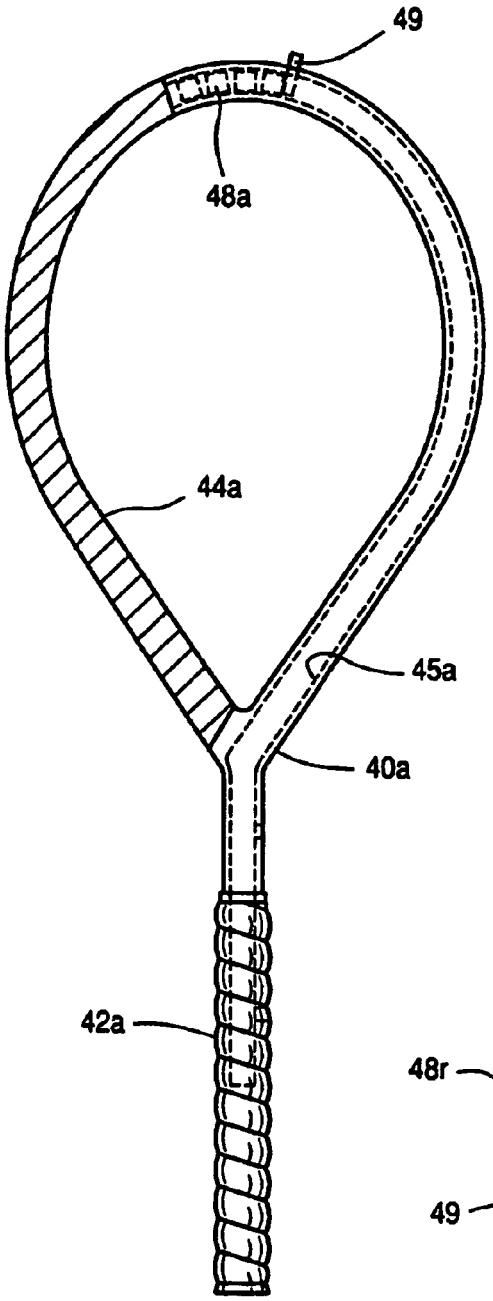
FIG. 4C is a front view of a racquet according to the present invention.
Figure 4E:
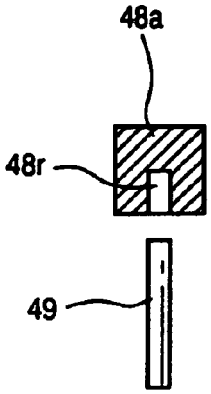
FIG. 4E is a cross-section view of a weight member and pin for use with the racquet of FIG. 4C.
Figure 4D:
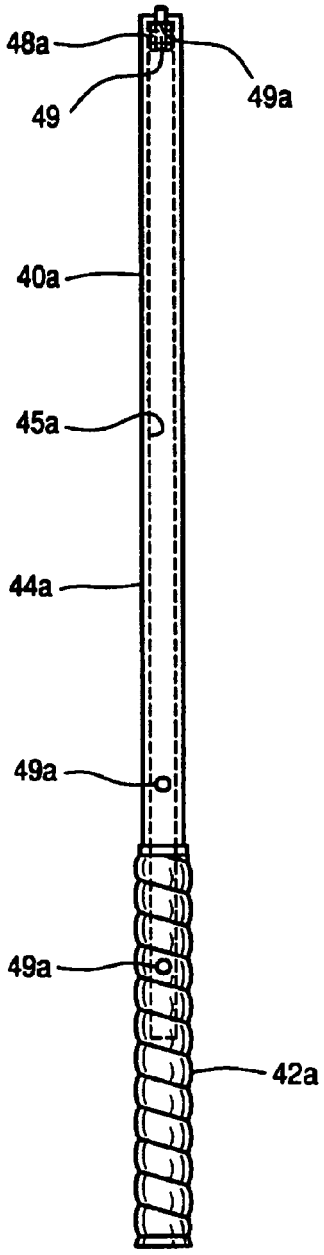
FIG. 4D is a side view of the racquet of FIG. 4C.

FIGS. 4C and 4D show a racquet 40*a* (like the racquet 40) but with a frame 44*a* having a channel 45*a* extending from within a handle 42*a* to a top of the frame. Within the channel 45*a* are one, two, three or more weight members 48*a*. A pin 49 (see, e.g. pin 49 in FIG. 4D) is insertable into, and removable from, a hole 49*a* through the frame (any desired member of holes 49*a* may be provided for maintaining the weight members 48*a* in a desired location in the channel 45*a*). Optionally, as shown in FIG. 4E in cross-section, a weight member 48*a* may have a recess 48*r* sized and located for receipt therein of a pin 49 (extending through a hole in the frame) to hold the weight member 48*a* in position in the channel 45*a*.

Figure 5A:
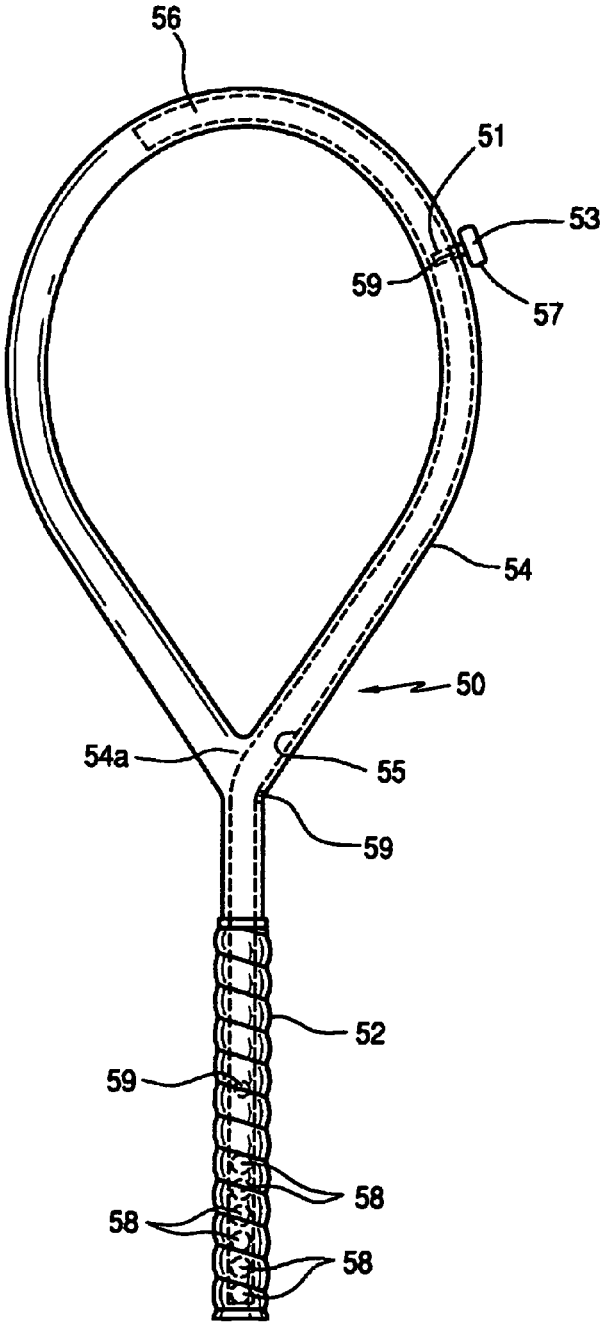
FIG. 5A is a front view of a racquet according to the present invention.
Figure 5B:
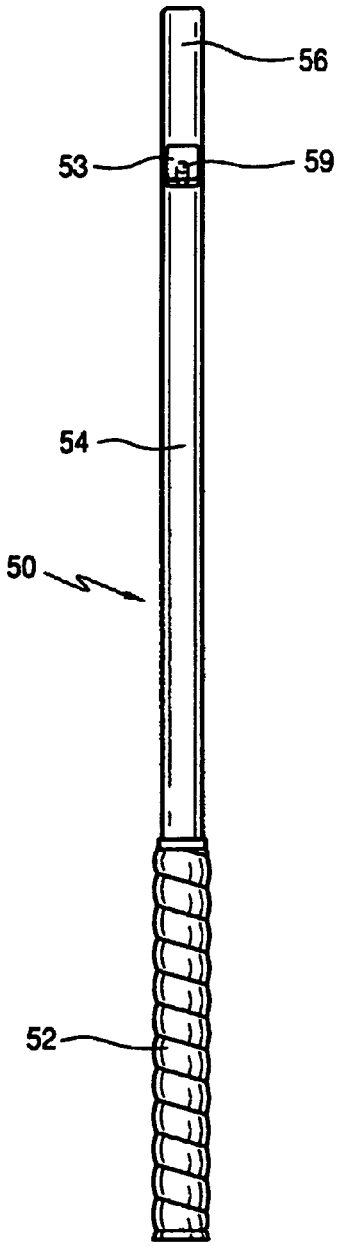
FIG. 5B is a side view of the racquet of FIG. 5A.

Referring now to FIGS. 5A and 5B, a game racquet 50 has a handle 52 and a body 54 across which are stretched a plurality of strings (not shown). A plurality of movable weight members 58 are movably disposed in an interior channel 55 in the handle 52 and the body 54. Upon inversion of the racquet 50, the weight members 58 move from handle 52 to a top 56 of the body 54. Upon arcing movement of the racquet 50, e.g. during a swing, serve or other movement of the racquet, centrifugal force maintains the weight members at the top 56 of the body 54. Upon re-inversion of the racquet the weight members move back down into the handle 52. A stop pin 57 has a shaft 51 which is removably and releasably insertable through a hole 59. A crossmember 53 facilitates manipulation of the stop pin 57. The stem 51 protruding into the channel 55 (after the weight members have moved to the top 56 of the racquet 50) prevents the weight member(s) (one or more may be used as desired) from moving back into the handle 52. The stop pin 57 may be selectively removed, e.g. after a serve, to allow the weight members 58 to return to the handle 52. Additional holes 59 may be provided as shown near a yoke 54*a* or in the handle 52 for using the pin 57 to maintain the weight member(s) in other locations.

Figure 6:
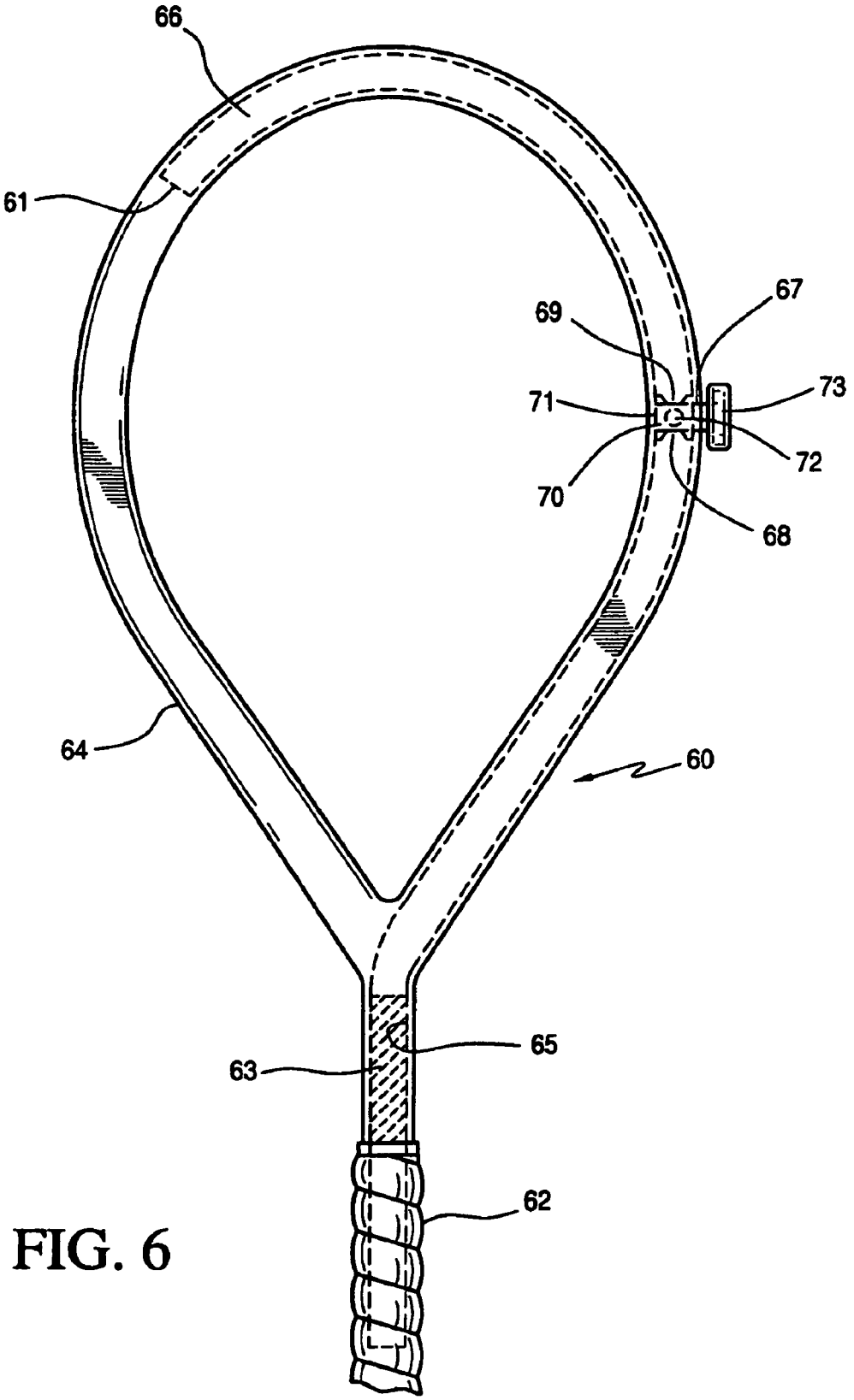
FIG. 6 is a front view of a racquet according to the present invention.

Referring now to FIG. 6, a game racquet 60 has a handle 62 and a body 64 across which are stretched a plurality of strings (not shown). An amount of liquid 63 is movably disposed in an interior channel 65 in the handle 62 and the body 64. A valve 70 has a stem 71 which blocks liquid flow in the channel 65 until the stem 71 is turned using a head 73 so that a hole 72 through the stem 71 is aligned with openings 68 and 69 of the channel 65. The head 73 protrudes exteriorly of the body 64 and facilitates manipulation and rotation of the valve stem 71. Upon inversion of the racquet 60 with the valve 70 open the liquid 63 moves from the handle 62 to a top 66 of the body 64. Upon re-inversion of the racquet 60 the liquids move back down into the handle 62. Such a valve may be located anywhere on the body 64 to maintain liquid in a desired location; and multiple valves may be used.

A racquet 70 according to the present invention as shown in FIG. 7 has a frame 74 with a handle 72, a yoke 77, and a top area 73. A weight member 78 is connected to the top area 73. It is within the scope of the present invention to use one, two, three or more weight members 78 and, as shown in outline, to place it or them in other desired locations on the frame 74. In certain aspects the weight member(s) 78 are permanently formed of or permanently or semi-permanently connected to the frame 74. In other aspects, the weight member(s) 78 are releasably connected to the frame 74, e.g. with a friction fit of a grasp member (e.g. the grasp member 75 as shown in FIG. 7A) or with amounts of releasably cooperating hook-and-loop fastener material (e.g. as amounts 79*a*, 79*b*); legs 75*a* of the grasp member 75 may be deleted in one aspect and the amounts 79*a*, 79*b* alone releasably holding the weight member(s) in place. In other aspects the weight member(s) 78 are located within the frame 74. As shown in FIG. 7B a weight member 78*b* may have a grasp member 75*b* with legs 75*c* having a shaped portion 75*d* shaped to conform to a shape of a racquet body for enhanced holding of the weight member of the body. FIG. 70 shows a weight member 78*f* with a body 78*g* from which a pointed projection 78*h* extends. The projection 78*h* is received in a corresponding hole 78*k* in the frame 74. The projection 78*h* can be so formed and made of such flexible material that pulling on the weight member 78*f* releases the weight member 78*f* from the hole 78*k*.

Figure 8A:
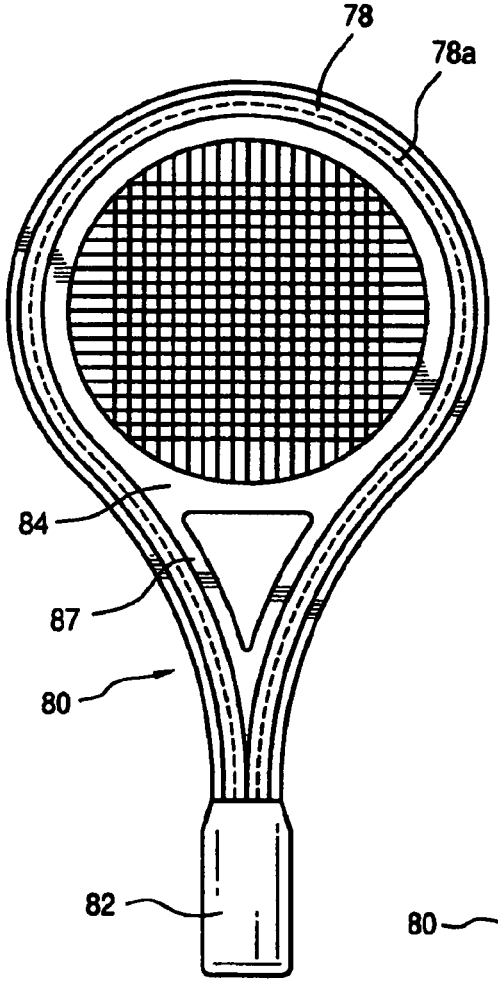
FIG. 8A is a front view of a racquet according to the present invention.
Figure 8B:
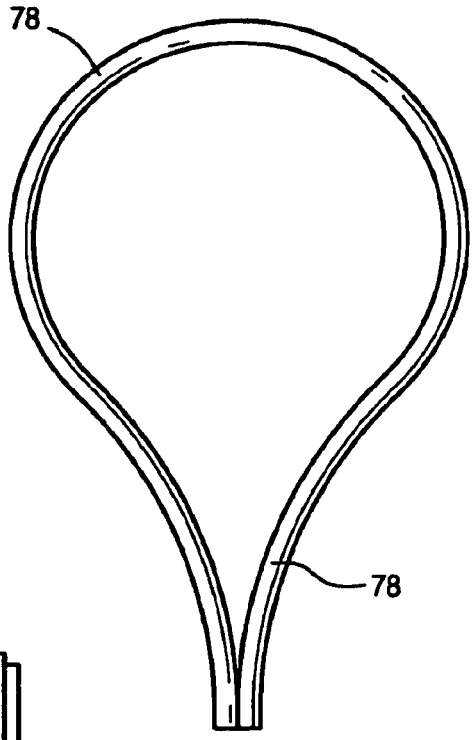
FIG. 8B is a front view of a channel member of the racquet of FIG. 8A.
Figure 8C:
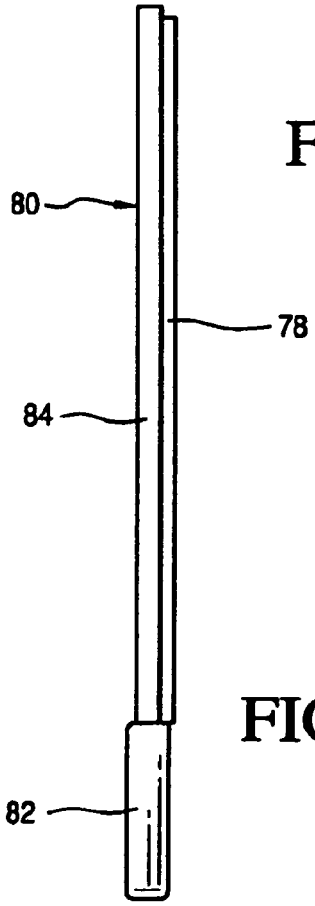
FIG. 8C is a side view of the racquet of FIG. 8A.

FIGS. 8A and 8B show a game racquet 80 according to the present invention with a frame 84, a handle 82 and a yoke area 87. A hollow tubing member 78 is connected (permanently or releasably) to the frame 84. Any material disclosed herein (liquid and/or weight member or members) is used within the hollow tubing, e.g. material 78*a* shown schematically in dotted lines. The tubing member 78 may be permanently formed of or secured to the frame 84; or it may be releasably connectible to the frame 84 in any suitable manner, e.g. using the items, materials, and/or connectors used to releasably connect a weight member 78 (FIG. 7A) to its frame. Optionally, the tubing may be of any desired length and may provide, exterior to a racquet body or frame (or club part), any interior channel disclosed herein, including, but not limited to, those of FIGS. 1A-6.

Figure 9:
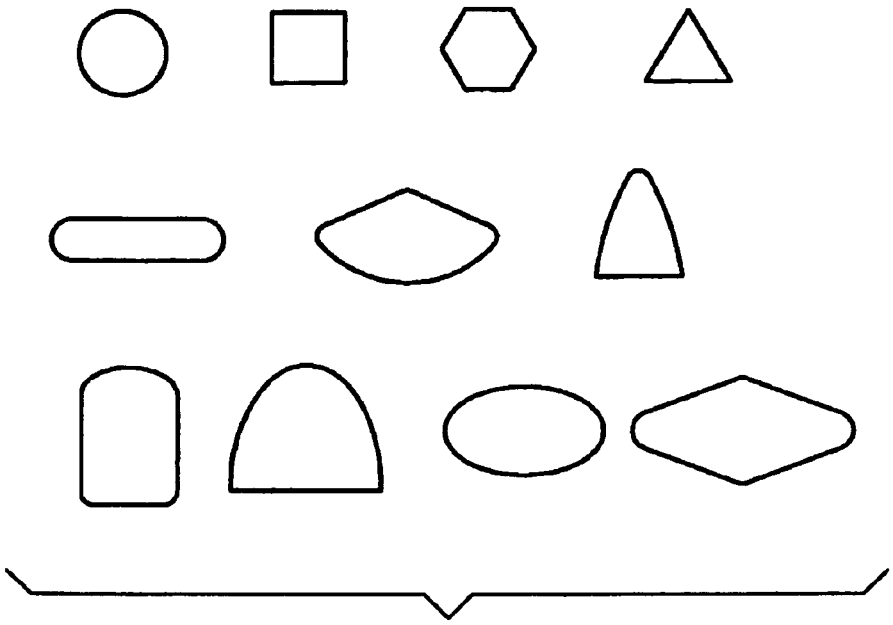
FIG. 9 presents cross-section views of items according to the present invention.

FIG. 9 presents a variety of cross-sectional shapes for any channel disclosed herein, any frame hole, any tubing, any racquet body or frame disclosed herein, and any weight member disclosed herein. With appropriate sizing, any weight member of any cross-sectional shape may be used in any channel of any cross-sectional shape.

Figure 10A:
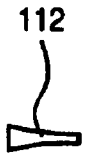
FIG. 10A is a side view of a weight member usable with the racquet of FIG. 10.
Figure 10:
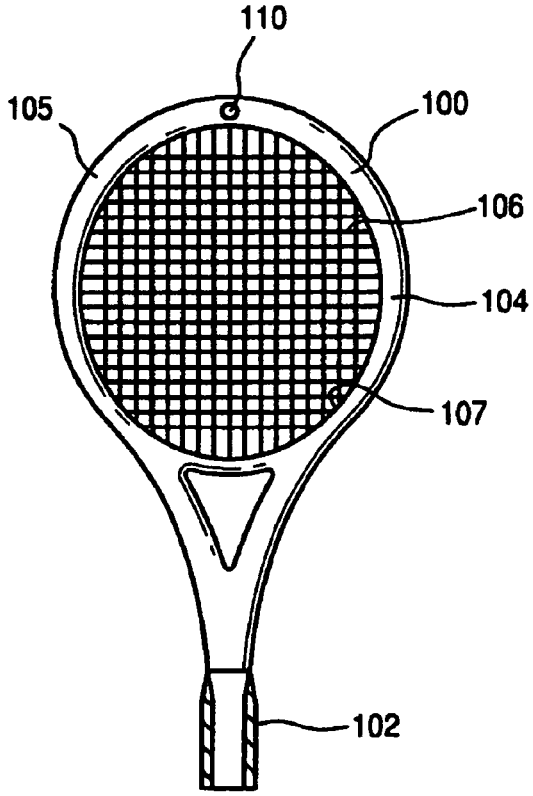
FIG. 10 is a front view of a racquet according to the present invention.

FIG. 10 shows a racquet 100 according to the present invention with a frame 104, handle 102, plurality of strings 106 across a frame opening 107, and a top area 105. A hole 110 extends through the top area 105. A weight member (e.g., like the weight member 112, FIG. 10A), is releasably insertable into the hole 110. One, two, three or more holes 110 may be used, each with a weight member releasably located therein.

Figure 11:
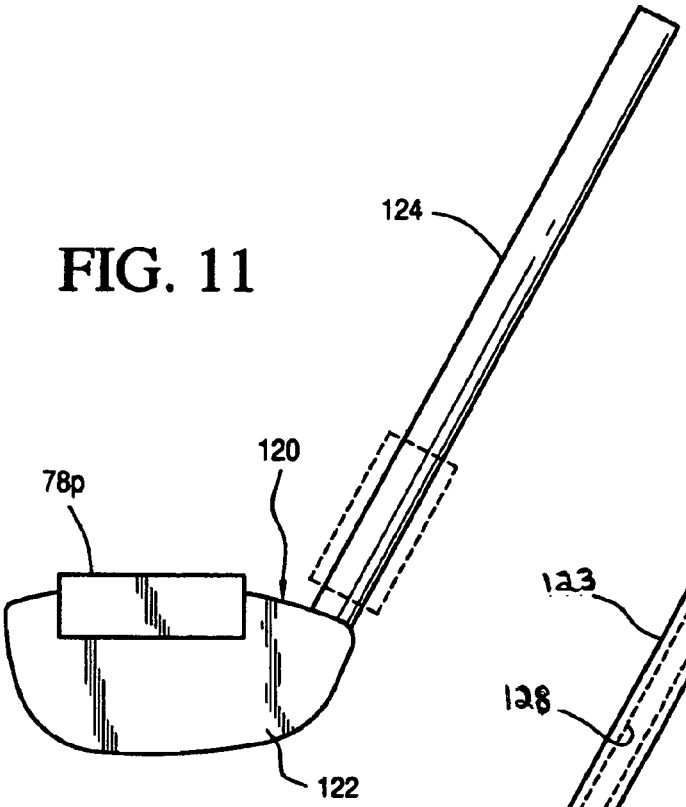
FIG. 11 is a side view of a golf club according to the present invention.

FIG. 11 shows a golf club 120 according to the present invention with a head 122 to which is connected a club shaft 124. A weight member 78*p* is releasably connected to the head 122 (connected as is any weight member disclosed and discussed herein). A weight member may be connected to any portion of the head 122 and, as shown in dotted lines, to the shaft 124 (and may be located anywhere on the shaft 124).

Figure 12:
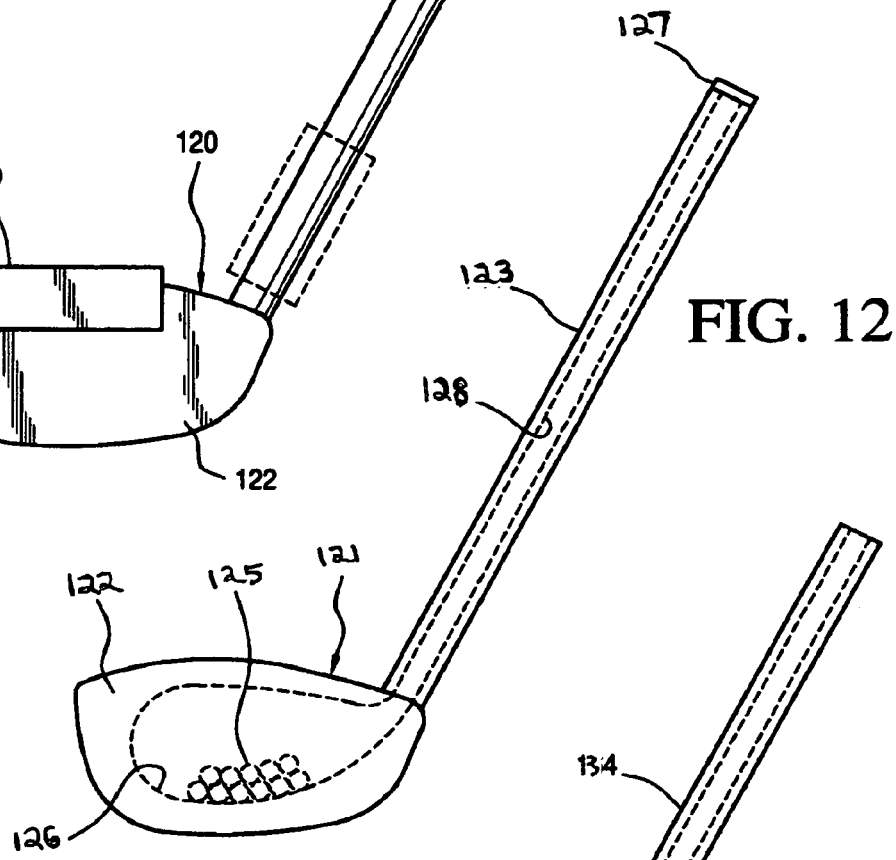
FIG. 12 is a side view of a golf club according to the present invention.

FIG. 12 shows a golf club 121 according to the present invention with a head 122 connected to a club shaft 123. An interior channel 128 in the shaft 123 is in communication with an interior space 126 in the head 122. The space 126 may be any desired shape (including the shapes shown in FIG. 9). A plurality of weight members 125 are in the space 126 as shown in FIG. 12. Upon inversion of the club 121, the weight members 125 move from the space 126 into the channel 128 to a top end of the channel 128 (which upon inversion of the club becomes the lowermost part of the club). Upon swinging of the club to hit a golf ball, the weight members are moved forcefully down the channel 128 back toward the space 126 and then into the space 126 augmenting the force of the head 122 hitting the ball as the head 122 hits the ball. A removable cap 127 selectively closes off the channel 128. Liquid or liquid and weight member(s) may be sued in the channel 128 for movement into the space 126. A single weight member may be used.

Figure 13:
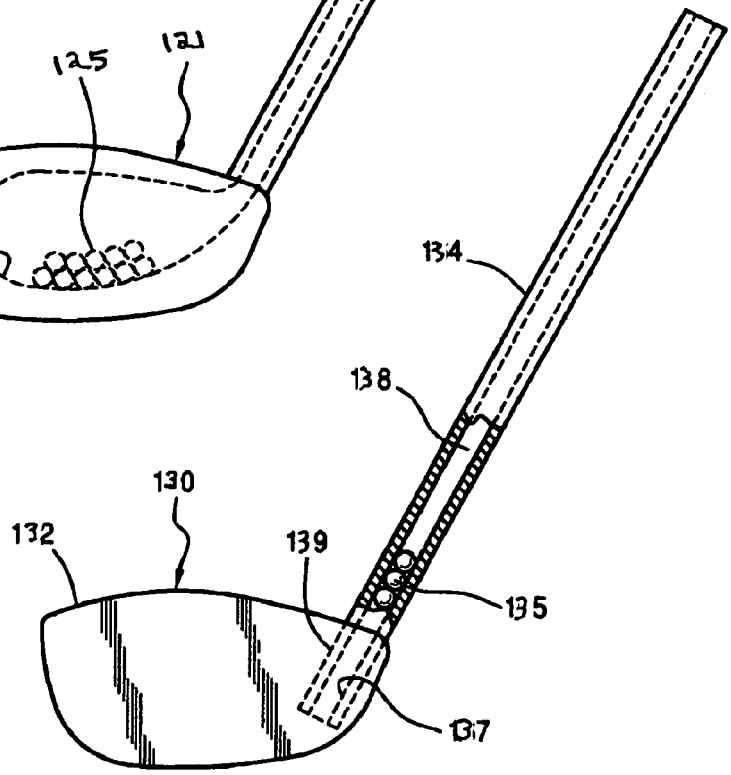
FIG. 13 is a side view of a golf club according to the present invention.

FIG. 13 shows a golf club 130 according to the present invention with a head 132 to which is connected a club shaft 134. A hollow tubing member 138 is connected to the shaft 134. Weight members 135 are within the tubing member 138 (only one weight member or two or more may be used). The tubing member 138 may extent only to the head's exterior or optionally, as shown in dotted lines, the tubing member 138 may extend into a hole 139 in the head 132 (and the weight member or members will be movable into and out of the head. The hole in the head 132 may extend to any point in the head so that the tubing member and weight member(s) moving therein can extend anywhere into the head 132.

Figure 14A:
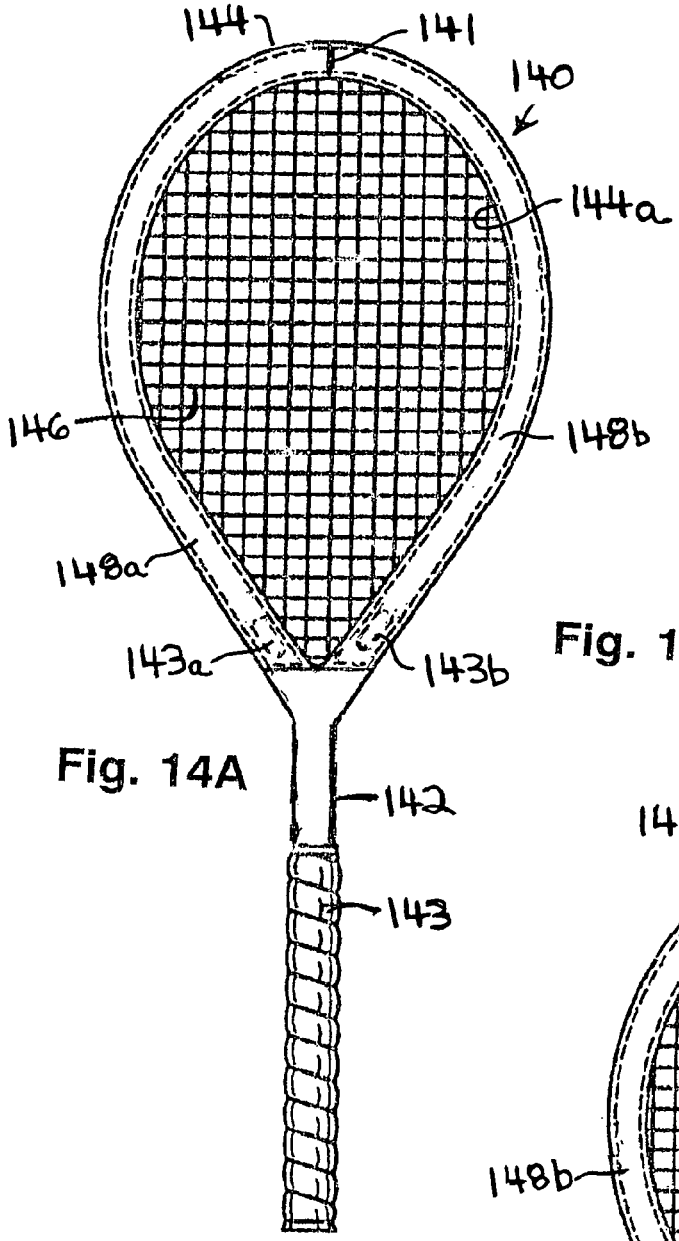
FIG. 14A is a front view of a racquet according to the present invention.
Figure 14B:
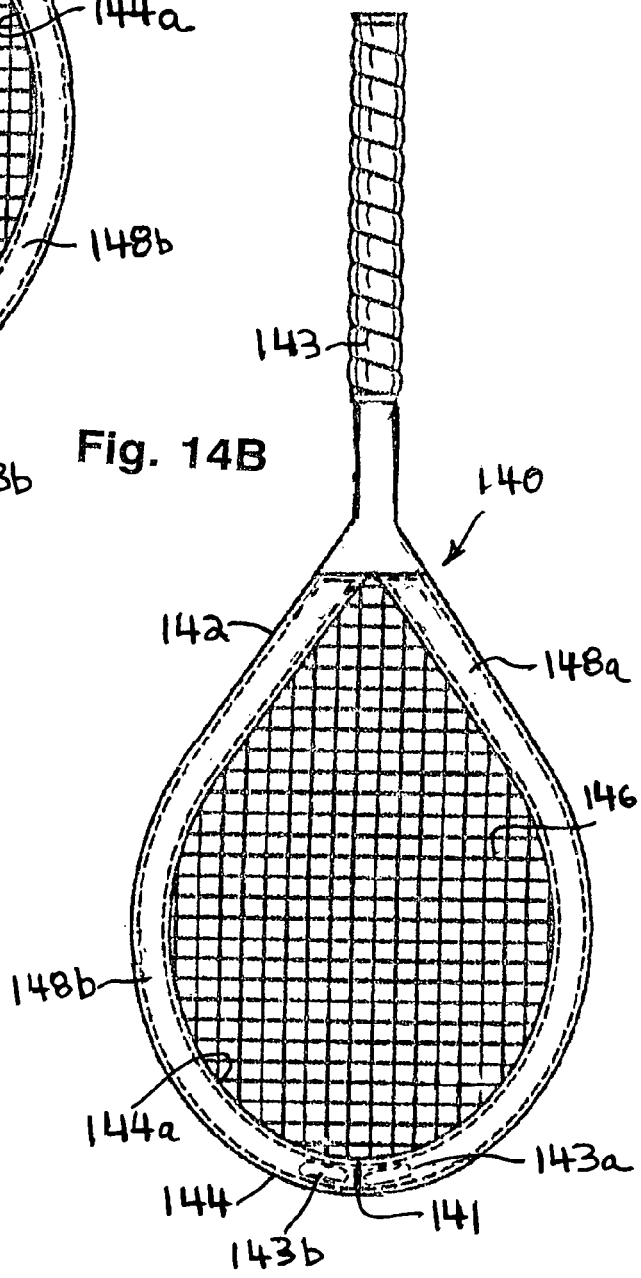
FIG. 14B is a front view of the racquet of FIG. 14A.

FIGS. 14A and 14B show a racquet 140 according to the present invention which has a body 142 with a handle 143 and a top portion 144 that defines an opening 144*a* across which are a plurality of strings 146 which are connected to the body 142. The handle 143 may be solid as shown, or it may be hollow.

The top portion 144 has interior opposed channels 148*a* and 148*b* each of which culminates at the top of the racquet 140. There is a barrier 141 within the top portion which prevents a weight member in one channel form passing into the other channel at the top of the racquet 140.

Weight members 143*a* and 143*b*, shown schematically, are meant to represent any weight member or weight members disclosed herein, solid, liquid, or solid/liquid combination. Upon inversion of the racquet (FIG. 14B) or swinging of the racquet, the weight members 143*a*, 143*b* move to the top portion in their respective channels 148*a*, 148*b* (for example, but not limited to, when the racquet is inverted at the beginning of a serve, when it is swung during a serve, or when it is swung to hit a ball). Upon movement of the racquet to at least a slightly upright position, the weight members will return to a position as in FIG. 14A.

Figure 14C:
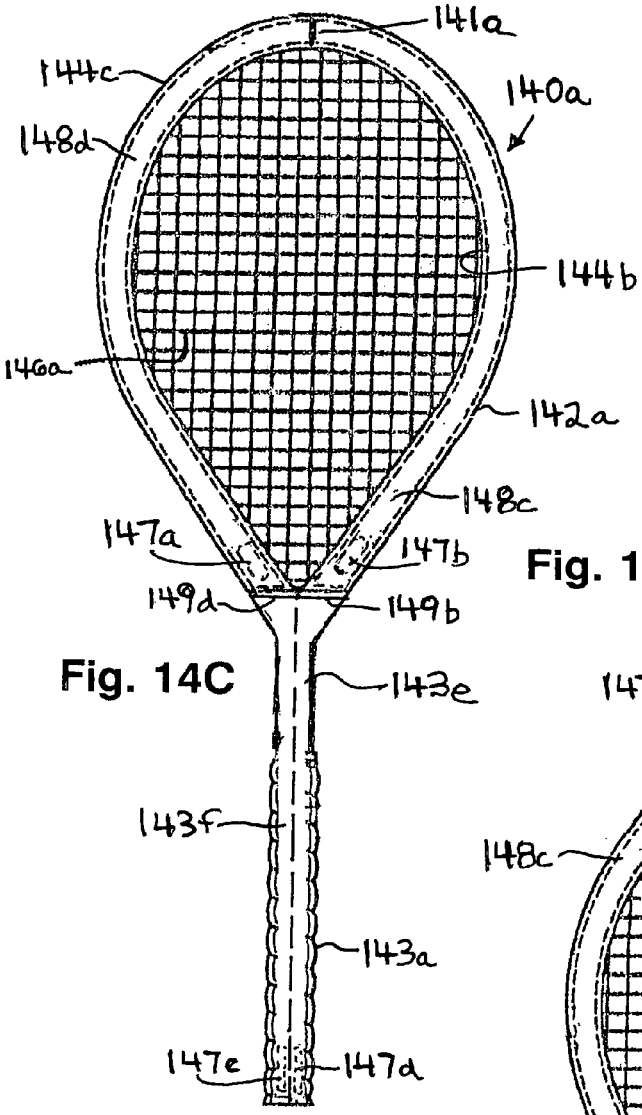
FIG. 14C a front view of a racquet according to the present invention.
Figure 14D:
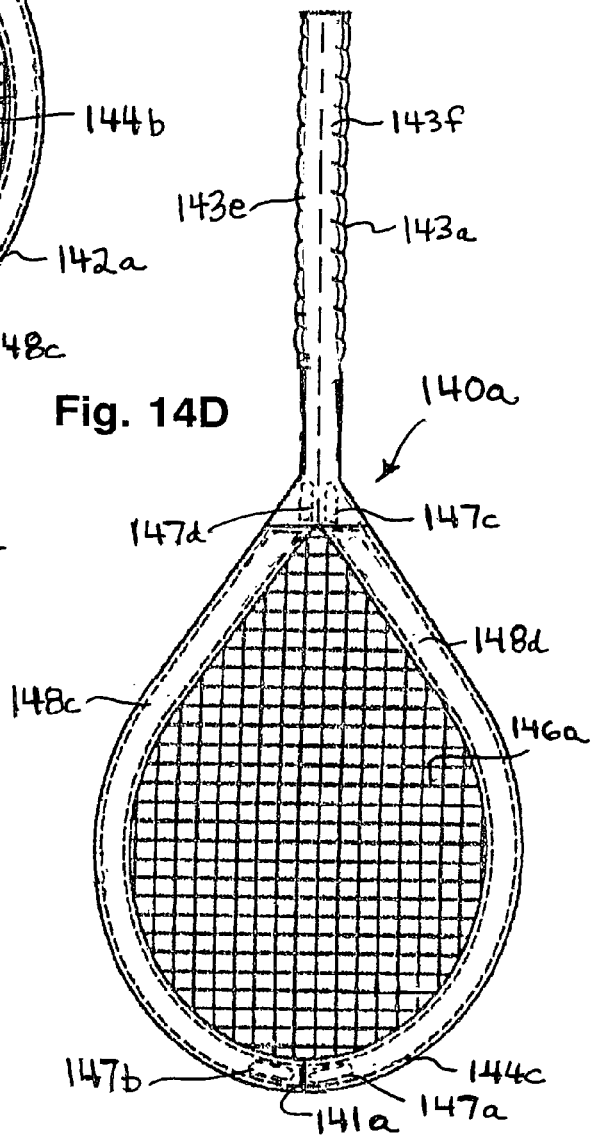
FIG. 14D is a front view of the racquet of FIG. 14C.

FIGS. 14C and 14D show a racquet 140*a* according to the present invention which is like the racquet 140 described above; but the racquet 140*a* has two sets of opposed channels so that weight members are positionable both at or near a top of a racquet and at a point at or near a mid-point of a racquet. It is within the scope of the present invention to provide weight stop members at any desired point on a racquet, including, but not limited to, the points labeled A-F (on either or both sides of a racquet, see FIG. 14D) to stop the movement of a weight member or members to such point(s) during racquet movement. The racquet 140*a* has a body 142*a* with a handle 143*a* and a top portion 144*c* that defines an opening 144*b* across which are a plurality of strings 146*a* which are connected to the body 142*a*.

The top portion 144*c* has interior opposed channels 148*c* and 148*d* each of which culminates at a top of the racquet 140*a*. At this point there is a barrier 141*a* within the top portion which prevents a weight member in one channel from passing into the other channel at the top of the racquet. The handle 143*a* has interior opposed channels 143*e* and 143*f* each of which extends partially into the top portion 144*c* and each of which culminates at an interior barrier 149*b* and 149*d* respectively.

Weight members 147*a*, 147*b*, 147*c*, and 147*d*, shown schematically, move in their respective channels and are meant to represent any weight member or weight members disclosed herein, solid, liquid, or solid/liquid combination. Upon titling of the racquet with the top thereof below horizontal or upon inversion of the racquet (FIG. 14D) or swinging of the racquet, the weight members 147*a*-147*d* move in their respective channels until they are stopped by their respective barriers. Upon movement of the racquet back with the top above horizontal or to an upright position, the weight members, the weight members will return to a position as in FIG. 14C.

Figure 15A:
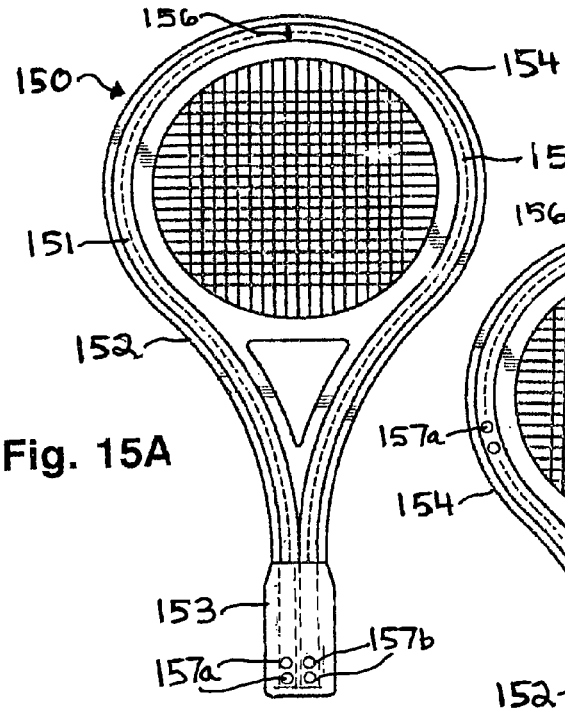
FIG. 15A is a front view of a racquet according to the present invention.
Figure 15B:
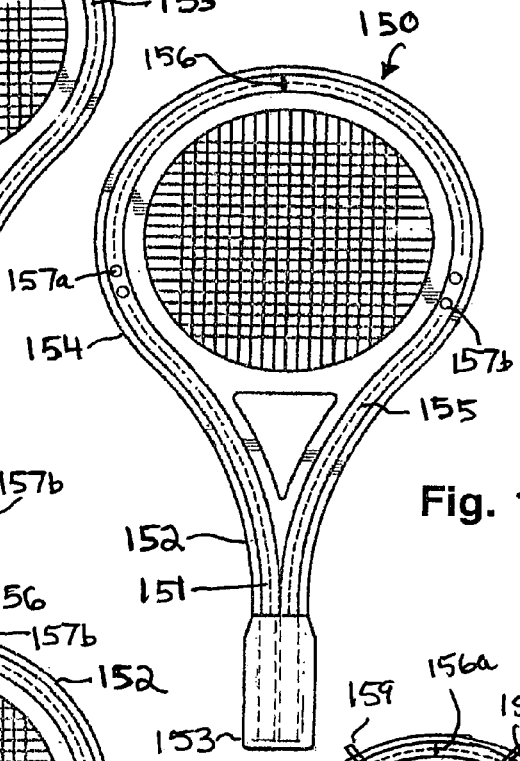
FIG. 15B is a front view of the racquet of FIG. 4A.
Figure 15C:
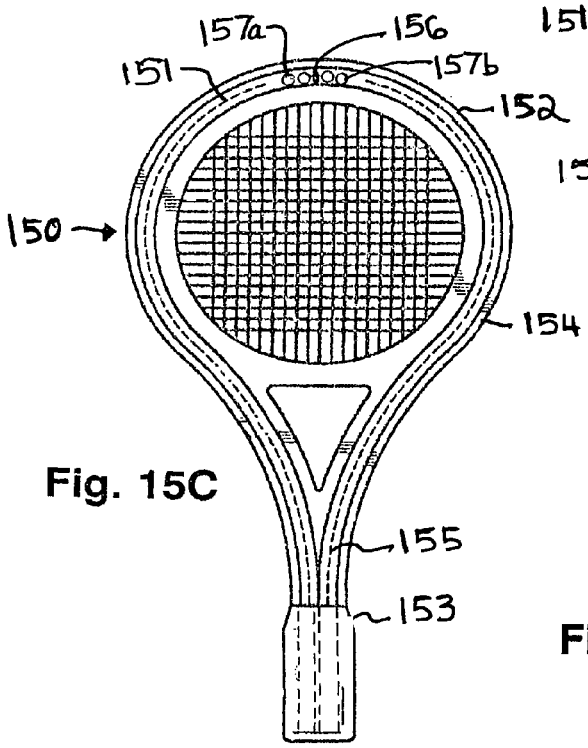
FIG. 15C is a front view of the racquet of FIG. 15A.

FIGS. 15A-15C show a racquet 150 according to the present invention which has a body 152 with a handle 153 and a body portion 154. Two opposed channels 151, 155 extend from the bottom of the handle 153 to the top of the body portion 154. A barrier 156 closes off each channel 151, 155 at the top of the body 152. Strings connected to the body 152 span an opening 159 in the body 152.

Weight members 157*a*, 157*b* in the channels 151, 155, respectively, are movable from the bottom of the handle 153 to the barrier 156. As shown in FIG. 15B tilting, moving, or swinging of the racquet or swinging of it with sufficient force moves the weight members 157*a*, 157*b* in their channels (or inversion of the racquet) toward the top of the racquet (and, similarly, toward the bottom of the handle 153 if the racquet it moved, swung, or tilted the other way). As shown in FIG. 15C, with sufficient force or tilting, the weight members move to the top of the racquet.

A single weight member may be used in each channel or any desired plurality of them. The weight member(s) may be solid, liquid, or liquid with solids therein. It is within the scope of the present invention to provide a barrier, e.g., like the barriers 141 and 156, in any of the racquets of FIGS. 1A, 2A, 3A, 3C, and 8A; and it is within the scope of the present invention to use a barrier at a point below the top point of a racquet (any disclosed herein) such as, but not limited to, the barriers 149*b*, 149*d*.

Figure 15D:
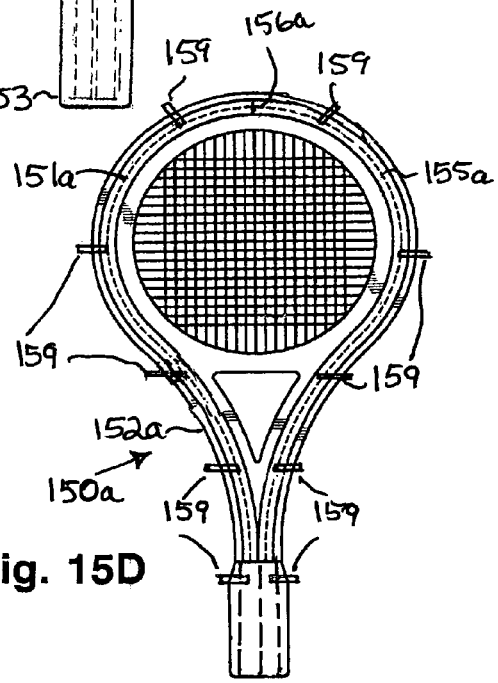
FIG. 15D is a front view of a racquet according to the present invention.

FIG. 15D shows a racquet 150*a* like the racquet 150 according to the present invention which has a plurality of removably emplaceable pins 159 which extend through a body 152*a* into channels 151*a* and 155*a* to serve as stops for weight member(s) at different locations in the channels (weight members not shown). Optionally, a barrier 156*a* is used at a top of the body 152*a*.

Figures 16A, 16B, 17A, 17B, 18A, 18B:
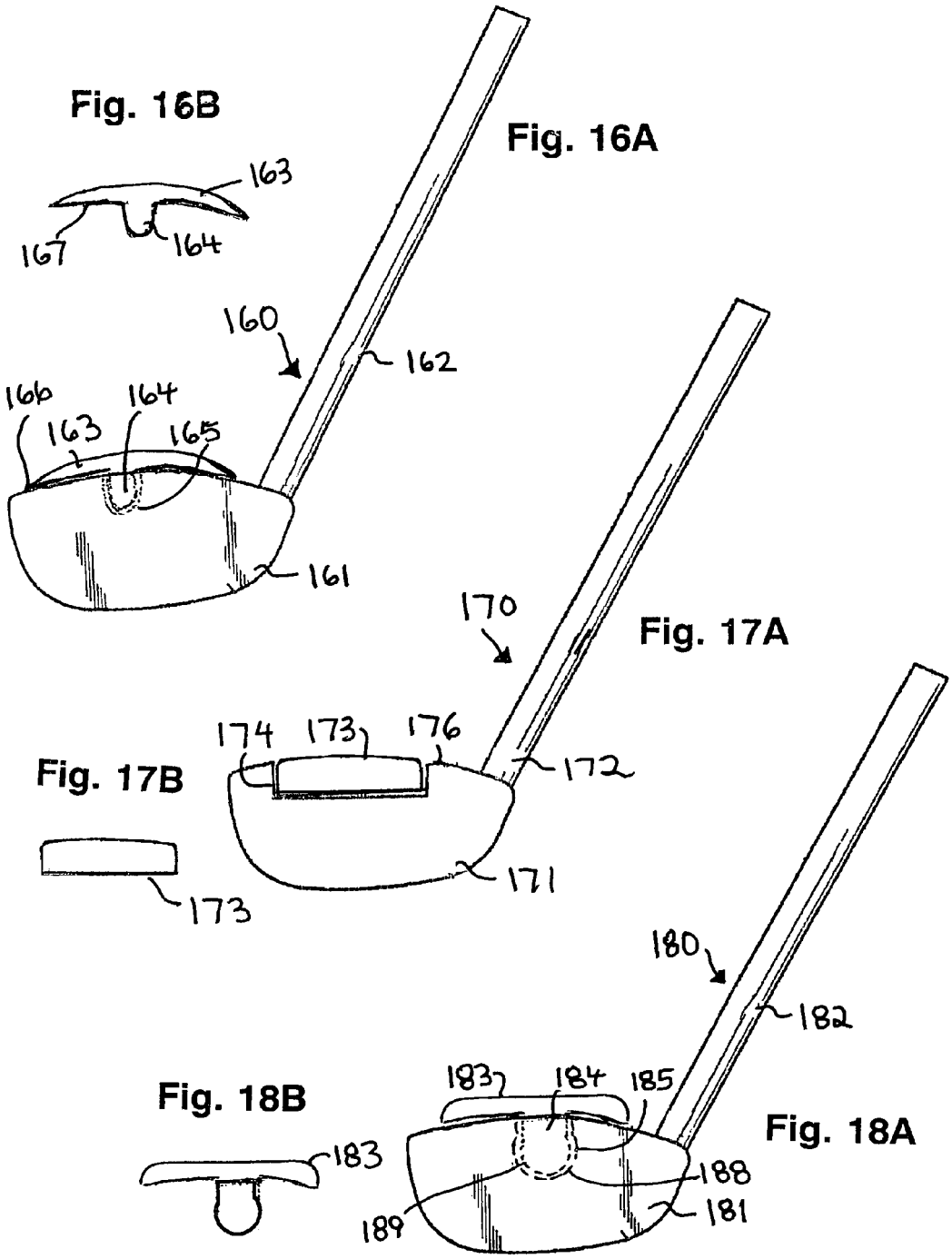
FIG. 16A is a side view of a golf club according to the present invention.
FIG. 16B is a side view of a weight member of the golf club of FIG. 16A.
FIG. 17A is a side view of a golf club according to the present invention.
FIG. 17B is a side view of a weight member of the golf club of FIG. 17A.
FIG. 18A is a side view of a golf club according to the present invention.
FIG. 18B is a side view of a weight member of the golf club of FIG. 18A.

FIG. 16A shows a golf club 160 according to the present invention which has a head 161 and a shaft 162. A weight member 163 (see FIG. 16B) has a stem 164 which is received in a corresponding recess 165 in the head 161. The stem 164 is held within the recess 165 by a friction fit and/or with adhesive.

The top of the head 161 has a curved surface 166 and a bottom surface 167 of the weight member 163 corresponds in shape to the shape of the surface 166. Optionally, a top surface of the weight member 163 is curved in shape so it is aerodynamically efficient. It is within the scope of this invention for the recess 165 to be at any desired location on the head 161; and for their to be any desired plurality of recess/weight-member combinations like the weight-member-163/recess-165 combination. Also, any weight member disclosed herein with suitable shape may be used as the weight member 163, and any suitable recess shape may be employed.

FIG. 17A shows a golf club 170 according to the present invention which has a head 171 and a shaft 172. A weight member 173 (see FIG. 17B) is within a recess 174 in the head 171. The weight member 173 is held within the recess 174 by a friction fit and/or with adhesive.

The top of the weight member 173 has a curved surface which provides a smooth transition with a top surface 176 of the head 171. It is within the scope of this invention for the recess 174 to be at any desired location on the body 172; and for there to be any desired plurality of recess/weight-member combinations like the weight-member-173/recess-174 combination. Also, any weight member disclosed herein with suitable shape may be used as the weight member 173, and any suitable recess shape may be employed.

FIG. 18A shows a golf club 180 according to the present invention which has a head 181 and a shaft 182. A weight member 183 (see FIG. 18B) has a stem 184 with an enlarged end 189 within a recess 185 in the head 181 which has an enlarged portion 188 which corresponds to the enlarged end 189. The weight member 183 is releasably held within the recess 185 by a snap fit of the enlarged end 189 in the enlarged portion 188 of the recess 185.

It is within the scope of this invention for the recess 185 to be at any desired location on the head 181; and for there to be any desired plurality of recess/weight-member combinations like the weight-member-183/recess-185 combination. Also, any weight member disclosed herein with suitable shape may be used as the weight member 183, and any suitable recess shape may be employed.

It is within the scope of the present invention to provide a set of a plurality of weight members for a game apparatus, including, but not limited to, a golf club or a racquet. The weight members of the set can differ in shape, weight, volume, size, color, marking indicia, and/or density so that the members are identifiable, can identify things to which they are connected, and/or so that effects of the use of a weight member can be varied as desired with a single game apparatus, including, but not limited to, a single club or racquet. Any desired number of weight members may be in the set.

Figure 19A:
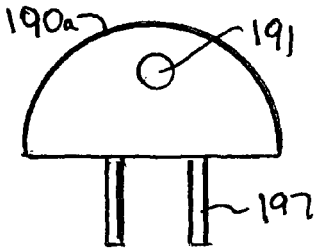
FIG. 19A is a side view of a weight member according to the present invention.
Figure 19B:
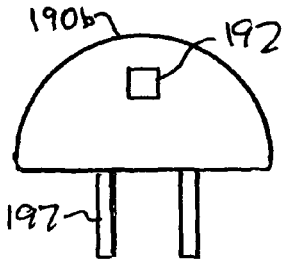
FIG. 19B is a side view of a weight member according to the present invention.
Figure 19C:
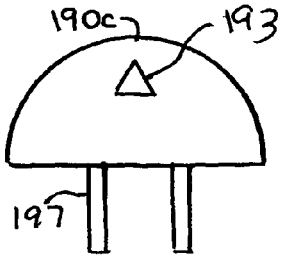
FIG. 19C is a side view of a weight member according to the present invention.

FIGS. 19A, 19B, and 19C show, respectively, weight members 190*a*, 190*b*, and 190*c* each of which has the shape shown (side view of a dome-shaped member) and each of which has substantially the same volume. The weight member 190*a* is made of material with a first density. The weight member 190*b* is made of material with a second density which is greater than the first density. The weight member 190*c* is made of material with a third density which is greater than the second density. Each weight member in FIGS. 19A, 19B, and 19C has a holding structure 197 for attaching or for releasably attaching the weight member to a part or portion of a club or of a racquet. Optionally, the weight members have different markings 191, 192, 193 as shown.

Figure 20A:
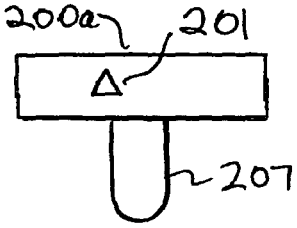
FIG. 20A is a side view of a weight member according to the present invention.
Figure 20B:
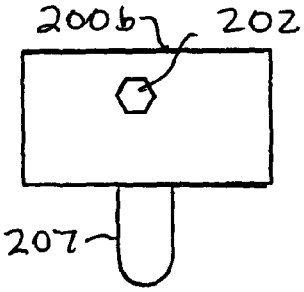
FIG. 20B is a side view of a weight member according to the present invention.
Figure 20C:
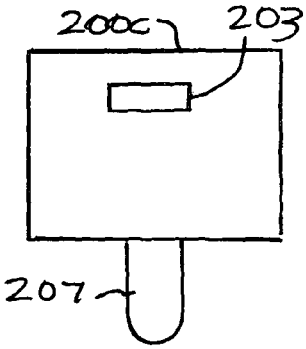
FIG. 20C is a side view of a weight member according to the present invention.

FIGS. 20A, 20B, and 20C show, respectively, weight members 200*a*, 200*b*, and 200*c* each of which has the shape shown (side view of a dome-shaped member) and each of which has a different volume. The weight members are made of the same material so that the weight member 200*b* weighs more than the weight member 200*a* and the weight member 200*c* weighs more than the weight member 200*a*. Each weight member in FIGS. 20A, 20B, and 20C has a stem 207 for connecting or for releasably connecting the weight member to a part or portion of a club or of a racquet with a recess corresponding to the shape of the stem. Optionally, the weight members have different colored markings 201, 202, and 203.

Figure 21A:
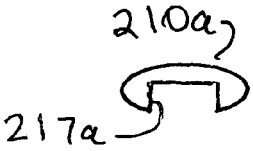
FIG. 21A is a side view of a weight member according to the present invention.
Figure 21B:
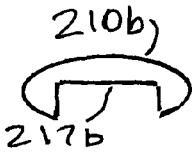
FIG. 21B is a side view of a weight member according to the present invention.
Figure 21C:
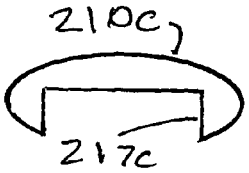
FIG. 21C is a side view of a weight member according to the present invention.

FIGS. 21A, 21B, and 21C show, respectively, weight members 210*a*, 210*b*, and 210*c* each of which has the shape shown (side view of a dome-shaped member) and each of which has a different volume. The weight members are made of the same material so that the weight member 210*b* weighs more than the weight member 210*a* and the weight member 210*c* weighs more than the weight member 210*a*. Each weight member in FIGS. 21A, 21B, and 21C has a recess 217*a*, 217*b*, and 217*c*, respectively, for connecting or for releasably connecting the weight member to a part or portion of a club or of a racquet with a recess corresponding to the shape of the stem.

Figure 22A:
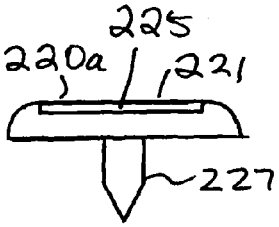
FIG. 22A is a side view of a weight member according to the present invention.
Figure 22B:
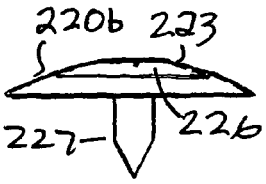
FIG. 22B is a side view of a weight member according to the present invention.
Figure 22C:
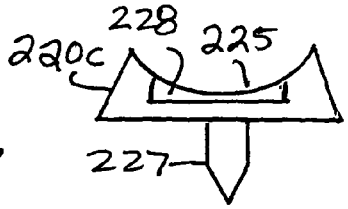
FIG. 22C is a side view of a weight member according to the present invention.

FIGS. 22A, 22B, and 22C show, respectively, weight members 220*a*, 220*b*, and 220*c* each of which has the shape shown and each of which has the same stem 227. The weight member 220*a* has to top portion 221 which is generally flat (with the shape generally of a flat-headed pin or tack). The weight member 220*b* has to top portion 223 which is generally round or curved (with the shape generally of a flat-headed pin or tack. The weight member 220*c* has to top portion 225 which is generally concave (and is circular or oval as viewed from above). Each weight member in FIGS. 22A, 22B, and 22C has the stem 207 for connecting or for releasably connecting the weight member to a part or portion of a club or of a racquet with a recess corresponding to the shape of the stem. Different colored markings 225, 226, and 228 are on the weight members.

The present invention, therefore, in at least certain embodiments, provides a game racquet with: a body, part of the body defining a body opening therethrough; a plurality of strings across the body opening and connected to the body; an interior channel extending through at least a portion of the body, the interior channel having at least a first part and a second part; weight material movably disposed in the interior channel for movement between the first part and the second part; and maintenance apparatus adjacent the interior channel for selectively maintaining the weight material in one of the first part and the second part. Such a game racquet may have one or some (in any possible combination) of the following: the weight material is liquid; the liquid is antifreeze; the weight material is at least one solid member; the at least one solid member is a plurality of solid objects; the body has a first hole, the first hole in communication with the interior channel, and the maintenance apparatus comprises a pin removably inserted into the first hole so that part of the pin projects into the interior channel and maintains the weight material at a desired location in the interior channel; the weight material is a solid member, the solid member having a secondary hole, a portion of the pin projecting into the secondary hole; the body has a second hole, and the pin selectively insertable into the first hole to maintain the weight material in the first part of the interior channel, the pin insertable into the second hole to maintain the weight material in the second part of the interior channel; the weight material is at least one movable weight member, the at least one movable weight member having a body with a stem projecting from the body into the slit, the maintenance apparatus is a slit in the body in communication with the interior channel, and the stem movable in the slit to selectively position the movable weight member in the interior channel at a desired location therein; wherein the at least one movable weight member has a knob exterior of the body, the knob connected to the stem; the weight material is liquid flowable between the first part and the second part, the maintenance apparatus is a valve member with a valve stem, the stem having a flow hole therethrough, and the stem located in the interior channel, the stem rotatable to stop fluid flow in the channel from the first part to the second part and the stem rotatable to selectively allow the liquid to flow through the stem from one of the first part or the second part of the interior channel to the other of the first part of the second part of the interior channel; a head connected to the stem, the head exterior to the interior channel, the head rotatable to rotate the stem; and/or the body is a main body and tubing is connected to the main body, the interior channel extending through the tubing.

The present invention, therefore, in at least certain embodiments, provides a body, part of the body defining a body opening therethrough; a plurality of strings over the body opening; at least one hole through the body; a weight member removably secured in the at least one hole. Such a game racquet may have one or some (in any possible combination) of the following: the at least one hole is a plurality of holes, including a first hole and a second hole, the first hole spaced apart from the second hole, and the weight member selectively insertable into either the first hole or the second hole; and/or wherein the body has a handle and a top area, the first part of the interior channel is in the handle, and the second part of the interior channel is in the top area.

The present invention, therefore, in at least certain embodiments, provides a golf club with: a head, the head having an interior space therein; a shaft connected to the head; weight material movably disposed with respect to the shaft for movement between a first position with respect to the shaft and a second position with respect to the shaft. Such a game racquet may have one or some (in any possible combination) of the following: wherein the head has an interior hole, the shaft is hollow, the weight material is within the shaft, and part of the shaft extends into the hole in the head so that the weight material is movable into the interior space in the head; and/or wherein the weight material is at least one weight member movably secured around the shaft.

What is claimed is:

1. A game apparatus comprising a body with a first portion for holding by hand and a second portion for hitting a ball; the first portion having a first end distal from the second portion and a second end adjacent the second portion; the first portion having a channel therethrough from the first end to the second end; the second portion having a space therein, the second portion having a space opening in communication with the space and with the second end of the first channel of the first portion; weight material movably disposed for movement in and through the first channel and into and from the space of the second portion; said movement including movement from the first end of the first channel, to and through the space opening, and into the space of the second portion; and said movement including movement from the space of the second portion, to and through the space opening, into the first channel, and to the first end of the first channel; and said movement initiated by manipulation of the body to subject the weight material to force that moves the weight material.

2. The game apparatus of claim 1 wherein the weight material is one of liquid, antifreeze, solid member, solid members, solid objects.

3. The game apparatus of claim 1 wherein the force that moves the weight material is a force that results from one of swinging the game apparatus, tilting the game apparatus, and inverting the game apparatus.

4. The game apparatus of claim 1 wherein the first portion is one of a handle of a racquet and shaft of a golf club; the second portion is, when the first portion is a handle of a racquet, a head of a racquet; and the second portion is, when the handle is a shaft of a golf club, a head of a golf club.

5. A game racquet comprising a body, part of the body defining a body opening therethrough, the body opening defined by a first side of the body and a second side of the body, the first side opposite the second side, the body having a top, the body opening having a bottom, a plurality of strings over the body opening, dual opposed channels adjacent the body opening comprising a first body channel and a second body channel, the first body channel in the first side and the second body channel in the second side, the first body channel extending within the body from the top of the body to the bottom of the body opening, the second body channel extending within the body from the top of the body to the bottom of the body opening, a weight member is not passable from the first body channel to the body second channel, a first weight member movably disposed within the first body channel, a second weight member movably disposed within the second body channel, movement of each weight member within its respective channel initiated by manipulation of the body to subject the weight material to force that moves the weight material.

6. The game racquet of claim 5 wherein each weight member is one of liquid, antifreeze, solid member, solid members, solid objects.

7. The game racquet of claim 5 wherein the force that moves each weight member is a force that results from at least one of swinging the game racquet, tilting the game racquet, and inverting the game racquet.

8. The game racquet of claim 5 further comprising, a barrier at the top of the body for stopping weight members in each of the first body channel and the second body channel.

9. The game racquet of claim 5 further comprising a handle connected to the body, the handle having a first handle channel in communication with the first body channel, the first weight member movable within the first handle channel and movable from and to the first body channel, and the handle having a second handle channel in communication with the second body channel, the second weight member movable within the second handle channel and movable from and to the second body channel.

10. The game racquet of claim 9 wherein the handle has a lower end and the first handle channel extends to a point within the handle adjacent the lower end of the handle, and the second handle channel extends to a point within the handle adjacent the lower end of the handle.

11. The game racquet of claim 5 further comprising the body having at least one hole for receipt therein of a pin, the at least one hole communicating with a channel of the game racquet, the pin insertable into the at least one hole for limiting movement of a weight member within a channel.

12. The game racquet of claim 11 further comprising the at least one hole comprising a series of spaced apart holes, each hole communicating with one of the first body channel and the second body channel.

13. The game racquet of claim 12 further comprising a plurality of pins, each pin insertable into one of the spaced apart holes.

14. The game racquet of claim 13 further comprising the pins insertable into the holes so that weight members are maintained at multiple desired locations of the body channels.

15. The game racquet of claim 5 wherein the weight members are movable within their respective channels in balanced manner as the game racquet is moved.

* * * * *